United States Patent [19]

Cellar, Jr.

[11] Patent Number: 4,910,928

[45] Date of Patent: Mar. 27, 1990

[54] BUILDING STRUCTURE

[75] Inventor: Charles Cellar, Jr., Coronado, Calif.

[73] Assignee: International Honeycomb Corporation, University Park, Ill.

[21] Appl. No.: 166,235

[22] Filed: Mar. 10, 1988

[51] Int. Cl.[4] ..... E04B 7/00

[52] U.S. Cl. ..... 52/82; 52/282; 52/285; 52/806

[58] Field of Search ..... 52/82, 806, 285, 282

[56] References Cited

U.S. PATENT DOCUMENTS

| | | | |
|---|---|---|---|
| 2,440,449 | 4/1948 | Raemer | 52/82 |
| 3,281,999 | 11/1966 | Keely | 52/82 |
| 3,529,394 | 9/1970 | Wilkins | 52/806 X |
| 4,558,797 | 12/1985 | Mitchell | 52/282 X |
| 4,640,061 | 2/1987 | Trumley | 52/82 X |

*Primary Examiner*—Carl D. Friedman

*Attorney, Agent, or Firm*—Olson & Hierl

[57] ABSTRACT

A prefabricated building is provided. The prefabricated building consisting of wall panels having two resilient plates joined by honeycomb core and secured together by an upper frame which secures the top edges of the wall panels, a lower frame which secures the bottom edges of the wall panels and a plurality of connecting members with each connecting member securing two side edges of two corresponding wall panels. A roof is also provided to shelter the joined wall panels.

18 Claims, 2 Drawing Sheets

BUILDING STRUCTURE

TECHNICAL FIELD OF THE INVENTION

The present invention relates to building structures and in particular to prefabricated buildings.

BACKGROUND OF THE INVENTION

Several industries make use of a small, free-standing buildings. For example, such buildings can be used as ticket booths, information booths, snack bars, florist stands, souvenir shops, gift shops, newspaper stands, bus-stop shelters, and trade show displays. The need thus exist in several areas for sturdy, low cost, small buildings.

Such structures are traditionally built on the spot by carpenters using common building materials such as wood studs, nails and plywood. Building such small structures takes an inordinate amount of time as a result of the number of small pieces used in construction. Further, the cost of these standard building materials has skyrocketed in recent years which makes the use of such buildings quite costly.

Because of the relatively small size of these buildings, prefabrication has been largely ineffective. This ineffectiveness is because each component part in such buildings is quite small which increases the costs of prefabrication. Further, the time spent combining conventional prefabricated component parts is quite lengthy because of the number of small pieces involved. Simply put, the economy of scale needed to make conventional prefabrication cost effective is lost in buildings of such small size. Thus, what is needed is a building structure that is not only inexpensive but is also quick and easy to assemble.

SUMMARY OF THE PRESENT INVENTION

The present invention provides a prefabricated building structure in a kit form that is inexpensive to make as well as quick and easy to assemble.

The building is made up of a plurality of wall panels, with each wall panel having a top, a bottom and two side edges. Means such as connecting members are provided for connecting the side edge of one wall panel to the side edge of a corresponding adjacent wall panel. Means such as a lower frame are provided for securing the bottom edges of the plurality of wall panels. Means such as an upper frame are provided for securing the top edges of the plurality of wall panels. Finally, means for sheltering the connected wall panels are provided. Together the wall panels and the sheltering means enclose an area to form the building structure.

The wall panels are preferably made up of two resilient plates such as plywood connected by a honeycomb core. This allows the lightweight strength. The upper and lower frames provide grooves into which the top and bottom edges of the wall panel securely fit, respectively. The connecting members provide two grooves into which two side edges from two adjacent wall panels securely fit. The frames and connecting members are made of a strong, light weight material such as aluminum or injection molded plastic.

In a preferred embodiment, the sheltering means is a roof which is secured to the assembled wall panels to complete the building structure. The roof can be made of a frame secured under a waterproof cloth, or ABS plastic cover, in an umbrella type arrangement.

The present invention can thus be easily assembled by as few as two unskilled laborers in a matter of a few minutes without the use of the studs and nails. Use of the honeycomb constructed wall panels further makes the cost of such building economical.

DETAILED DESCRIPTION OF A PREFERRED EMBODIMENT

Figure 1:
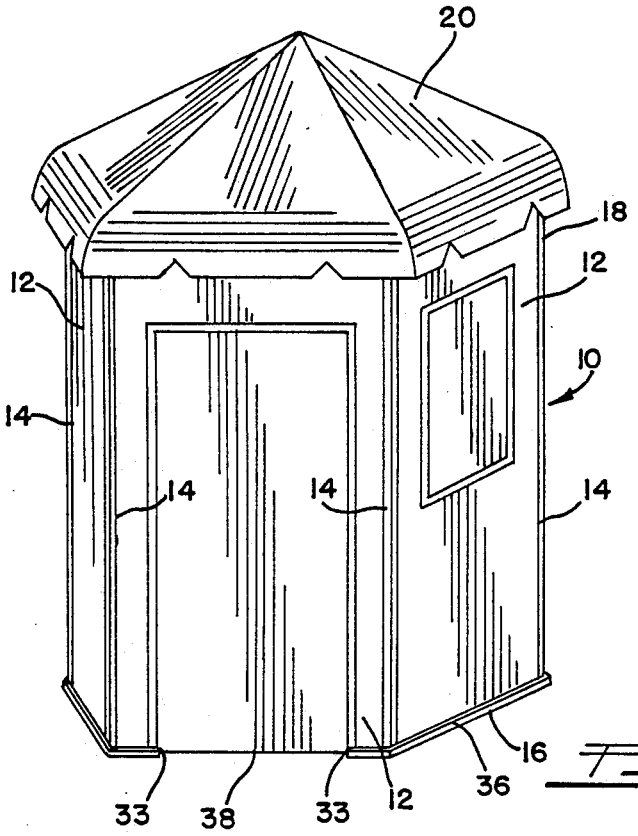
FIG. 1 is a perspective view of an assembled building utilizing the present invention.

Referring to FIG. 1, the completed building assembly of the present invention is designated generally at 10. The building assembly includes a plurality of wall panels 12, a plurality of connecting members 14, a lower frame member 16, an upper frame member 18, and an umbrella roof 20.

Figure 2:
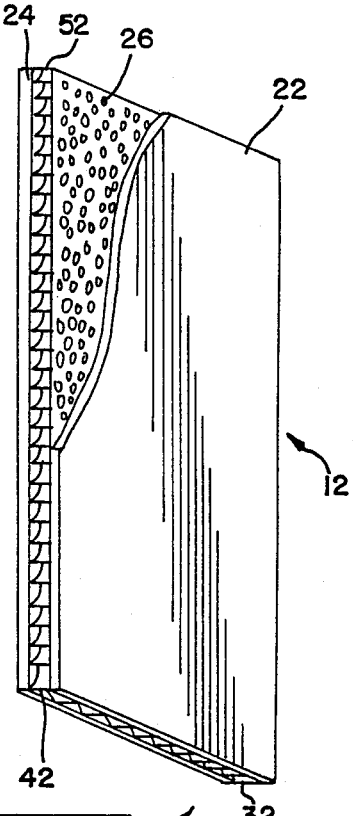
FIG. 2 is a perspective view of a wall panel of the present invention with one resilient plate cut away to show the honeycomb filler.

Referring to FIG. 2, the wall panels of the present invention is indicated generally at 12. The wall panel 12 has an outer resilient plate 22 which is cut-away for illustration purposes. The outer resilient plate 22 is fastened to an inner resilient plate 24 by a honeycomb core 26.

The outer resilient plate 22 and the inner resilient plate 24 are made up of material resistant to denting and able to withstand environmental effects if outside use is contemplated. A good, low cost material has been found to be ⅛ or ¼ inch (0.32 or 0.65 cm) thick plywood, but other materials such as hard board will be apparent to those skilled in the art. The outer resilient plate 22 may be covered with suitable material depending on the intended use of the wall panels 12, such as, for example, wood panels, composition materials, prefinished steel or aluminum siding.

The honeycomb core 26 can be made of expandable kraft paper as a good, lightweight, low cost material. Typical weights for the honeycomb filler are 12 pounds per 1000 square feet of 1 ½ inch thick honeycomb (6.18 kg per 100 square meters of 3.8 cm honeycomb). Other honeycomb materials will be apparent to those skilled in the art. If kraft paper or a similar material is used for the honeycomb core 26, strength and water repellency can be enhanced by chemically treating the kraft paper to add phenolic resins or other suitable chemicals.

Generally the honeycomb core 26 is made of an interior honeycomb core having a cell size of usually about 1 inch (2.5 cm). This provides great strength with a minimum amount of weight. If greater insulation is desired, the cells of the core can be filled with a material having a high R value, such as cellulose fiber.

The honeycomb core 26 can be fastened to the outer resilient plate 22 and the inner resilient plate 24 by any suitable means. In practice, it has been found that all contemplated surface facings can be fastened by use of an appropriate adhesive, such as MOR-AD 336 made by the Morton Chemical Company. This adhesive provides a permanent, water proof band. The adhesive is preferably applied as a full film coating to the outer resilient plate 22 and the inner resilient plate 24 and the honeycomb core 26 is sandwiched in between. This provides both good shear and compression performance.

By use of these materials, a strong, light-weight wall panel is created. As an example, a wall panel 12 was made up of ⅛ inch and ¼ inch (0.32 cm and 0.65 cm) thick facings by four feet (1.22 m) wide by eight feet (2.44 m) tall plywood or hard board used for the outer resilient plate 22 and the inner resilient plate 24. 1 ½ inch (3.9 cm) thick expanded kraft paper honeycomb core 26 with cell size of 1 inch (2.5 cm) was placed between the plates. The plates were fastened to the honeycomb filler and side facings by a MOR-AD 336 adhesive film applied as a full film. The resulting panel was 2 inches (5.2 cm) thick by four feet (1.22 m) wide by eight feet (2.44 m) tall and weighed less than 65 lbs.

While the wall panels described herein are solid, several different type wall panels are available. A door panel including a frame and an attached door (as shown in FIG. 1); a walk through panel having a door frame without a door; a window panel having a window opening (as shown in FIG. 1); and an electrical panel having electrical connectors built into a solid panel are just several examples of different panels available for use with the present invention.

Figure 3:
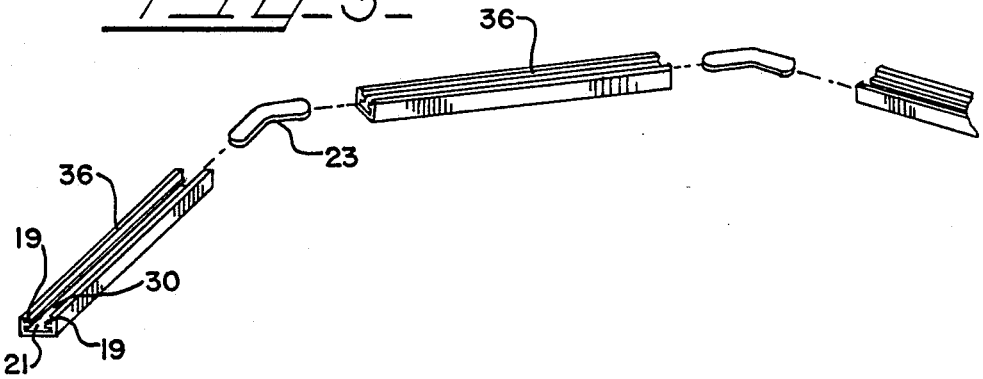
FIG. 3 is an exploded perspective view of part of the lower frame of the present invention.

Referring to FIG. 3, an exploded view of part of the lower frame member 16 which acts as means for securing the bottom edges of the wall panels 12 is seen. The lower frame 16 is comprised of a plurality of U-shaped beams 36 which are the same shape and length as the wall panels 12 with which they are to be used. The U-shape of the beams 36 defines a groove 30 into which the bottom wall panel 12 securely fits. Each beam 36 is made of a suitable lightweight, rigid material such as aluminum or injection molded plastic which provides ample support for the structure.

The U-shaped beams 36 include a ridge 19 protruding from each side thereby defining a slot 21. Into the slots 21 of two corresponding beams 36 is slid a connecting plate 23 made of suitable material such as aluminum or injection molded plastic. This connecting plate 23 can be angled as shown to define a corner of the building assembly or can be straight (not shown) to make a building side wider than the width of the individual wall panels 12. Thus, by using different combinations of the angled and straight connecting plates 23, building structures of various shapes and sizes can be assembled. An assembled lower frame 16 is seen in FIG. 5.

In use, the assembled lower frame 16 is placed on a flat surface where the completed structure is desired to be located. The wall panels 12 are inserted into the U-shaped grooves 30. Because the wall panels 12 rest against the ridges 19 protruding from each side of its U-shaped beams 36, the wall panels 12 are displaced from the ground. This helps to protect the wall panels 12 from the effects of ground moisture and the like. Further, as a result of the light weight of the wall panels 12, each wall panel 12 can be easily inserted by one person. After at least two wall panels 12 are so inserted, the builder can continue to the next step, explained below.

Figure 4:
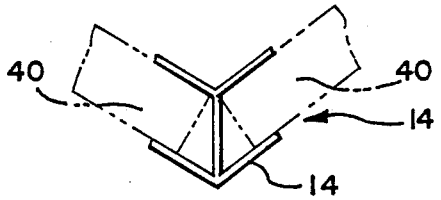
FIG. 4 is a cross-sectional view of a connecting member.
Figure 5:
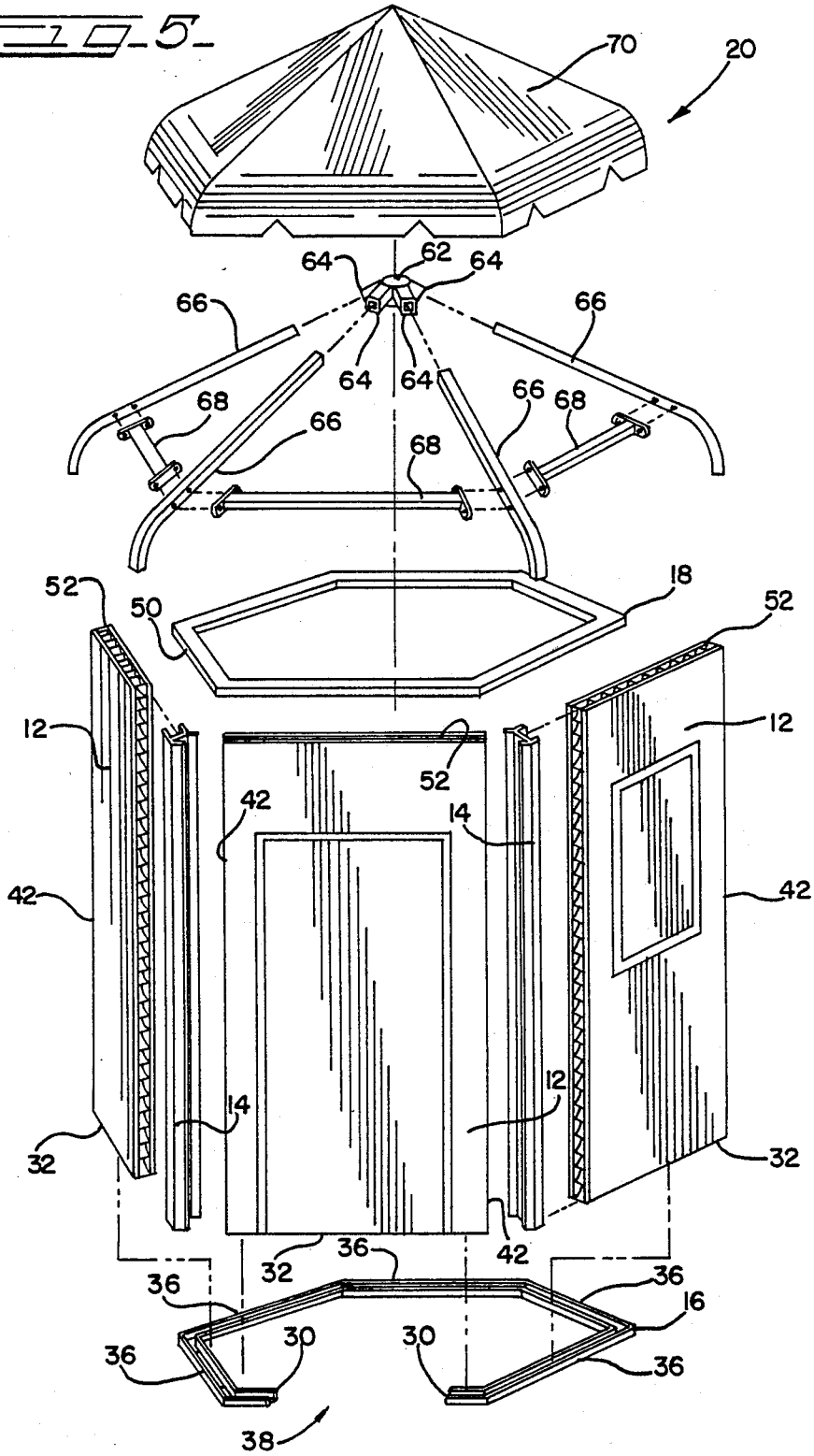
FIG. 5 is a partially exploded perspective view of the present invention.

As seen in FIG. 5, the assembled lower frame 16 is not a complete ring but rather includes a break 38 corresponding to one wall panel 122. This break is used for a door or walk-through panel to enable easy access into and out of the building. Depending on the desired use of the completed building, lower frames having different breaks can be used. Thus, in the frame depicted in FIG. 5, use as a ticket booth is likely contemplated by the builder Referring to FIG. 4, a cross-sectional view of the connecting member 14 which acts as means for securing the side edges of the wall panel is seen. The connecting member 14 is generally Y shaped but also includes a lower split cross piece 44 thereby defining two generally C-shaped grooves 40. The angle of these grooves 40 is determined by the size and shape of the building.

The grooves 40 are sized to fit securely over the side edge 42 of the wall panels 12. In use, after two wall panels 12 are placed in their corresponding positions in the lower frame 16, a connecting member 14 is slid over the side edges 42 which fit into the C- shaped grooves 40. To provide the secure fit over the side edges 42 while providing lightweight strength, the connecting members 14 are made of a suitable material such as aluminum or injection molded plastic.

Referring to FIG. 5, a partially exploded view of the present invention is seen. The upper frame 18 is assembled similarly to the lower frame 16 and acts as means for securing the top edges of the wall panels. The upper frame 18 thus includes a generally U-shaped groove 50 which securely fits over the top edge 52 of the wall panel 12. The assembled upper frame 18 is different from the lower frame 16 in that it is an unbroken ring which provides integral support to the structure. Like the lower frame 16 and the connecting members 14, the upper frames 18 is made of a suitable light weight material such as aluminum or injection molded plastic.

After the wall panels 12 have been fit into the lower frame 16 and the connecting members 14 slid over two side edges 42 of the wall panels 12, the upper frame 18 is affixed over the top edges 52 of the wall panels 12. The building is then completed save for means for sheltering the connected wall panels, such as a roof.

While many different types of roofs can be used in the present invention, the preferred embodiment described herein contemplated use of an umbrella-type roof 20 which is assembled by the builder.

The umbrella-type cloth roof 20 includes a hub 62 having a plurality of slots 64 into which support spokes 66 securely fit. A plurality of reinforcing bars 68 are provided which are securely fastened between the support spokes 66 distally from the hub 62. A waterproof sheet covering such as re-enforced vinyl 70 is stretched over and secured onto the assembled umbrella frame and the frame is then securely fastened to the upper frame 18.

Thus, a prefabricated building can be easily assembled by as few as two people. By combining different panels, the user can quickly assemble several different displays. Thus, if a walk-through gazebo is desired, two walk-through panels can be combined with four window panels; if a ticket booth is desired, one door panel and one window panel can be combined with four solid panels; if a different type display is desired, any suitable combination of window and solid panels can be used.

In addition, various size buildings can be erected following the procedures outlined above. All can include any combination of doors, windows and solid panels arranged as the builder would desire.

It should be understood that various modifications, changes, and variations may be made in the arrangement, operation, and details of construction of the elements disclosed herein without departing from the spirit and scope of this invention.

What is claimed is:

1. A self supporting building structure that is placed on a generally flat surface or ground comprising:

a plurality of wall panels, each wall panel having a top, a bottom, and two side edges;

means for releasably connecting the side edge of one wall panel to the side edge of a corresponding adjacent second wall panel;

a lower frame member which is placed on a generally flat surface releasably securing the bottom edges of the wall panel and displaces the wall panels off the ground;

an upper frame member releasably securing the top edges the wall panels, the connecting means, lower frame member and upper frame member cooperating to support the wall panels without the need of external support; and means secured to the wall panels for sheltering the connected wall panels comprising a sheet covering and a plurality of support spokes securely fastened to the upper frame member and joined in a hub, the support spokes being covered with the sheet covering and being support by a plurality of reinforcing bars securely fastened between the support spokes distally from the hub.

2. The building structure of claim 1 wherein each wall panel includes an outer resilient plate, an inner resilient plate, and a honeycomb core connecting the outer resilient plate and the inner resilient plate.

3. The building structure of claim 1 wherein the means for connecting the side edges are connecting members which secure two side edges of two corresponding adjacent wall panels.

4. The building structure of claim 1 wherein the wall panels are displaced off the ground by being supported on ridges provided on the lower frame member.

5. The building structure of claim 1 wherein the lower frame member is comprised of a plurality of individual U-shaped beams secured together by connection plates.

6. The building structure of claim 1 wherein the upper frame member is comprised of a plurality of individual U-shaped beams secured together by connecting plates.

7. A self supporting building structure that is placed on a generally flat surface or ground comprising:

a plurality of wall panels, each wall panel having an outer resilient plate, an inner resilient plate, and a honeycomb core connecting the outer resilient plate and the inner resilient plate thereby defining a top edge, a bottom edge, and two side edges;

a plurality of releasable connecting members, each connecting member having two grooves into which two side edges of two corresponding adjacent wall panels removably and securely fit;

a generally U-shaped lower frame member, adapted to be placed on a generally flat surface, the frame member having ridges which together with the U-shaped lower frame member define a groove into which the bottom edges of the plurality of wall panels removably and securely fit and displaces the wall panels off the ground;

an upper frame member having a groove into which the top edges of the plurality of wall panels removably and securely fit, the connecting members, lower frame member and upper frame member cooperating to support the wall panels without the need of external support; and a roof securely fastened to the upper frame member, the roof comprising a sheet covering and a plurality of support spokes securely fastened to the upper frame member and joined in a hub, the support spokes being covered with the sheet covering and being supported by a plurality of reinforcing bars securely fastened between the support spokes distally from the hub.

8. A process of erecting a prefabricated self supporting structure that is placed on a generally flat surface or ground without the need for external support comprising:

securing a plurality of individual U-shaped beams together to define a lower frame member;

securing a plurality of individual U-shaped beams together to define an upper frame member;

inserting a plurality of wall panels, each wall panel having a top, a bottom, and two side edges, into a groove contained in the lower frame member so the bottom edges of the wall panels are releasably secured therein and the lower frame member displaces the wall panels off the ground;

sliding a plurality of releasable connecting members, each connecting member having two grooves into which two side edges of two wall panels fit, over the side edges of the plurality of wall panels so the side edges of the wall panels are releasably secured therein;

affixing the upper frame member which includes a groove into which the top edges of the wall panels fit over the top edge of the plurality of wall panels so the top edges of the wall panels are releasably secured therein; and releasably securing a roof to the upper frame member by fastening a plurality of support spokes to the upper frame member and a hub and fastening a plurality of reinforcing bars between the support spokes distally from the hub and stretching a sheet covering over the support spokes.

9. A prefabricated self supporting building kit having component parts capable of being assembled in the field comprising:

a plurality of wall panels, each wall panel having a top, a bottom and two side edges;

a plurality of releasable connecting members, each connecting member having two grooves into which two side edges of two corresponding adjacent wall panels releasably and securely fit;

a generally U-shaped lower frame member adapted to be placed on a generally flat surface, the lower frame member having ridges which together with the U-shape define a groove into which the bottom edges of the wall panels releasably and securely fit and are displaced off the ground, the lower frame member comprising a plurality of individual U-shaped beams adapted to be secured together by connecting plates;

an upper frame member having a groove into which the top edges of the wall panels releasably and securely fit, the upper frame member comprising a plurality of individual U-shaped beams adapted to be secured together by connecting plates; and a roof comprising a plurality of support spokes adapted to be releasably secured to the upper frame member in a hub, a plurality of reinforcing bars between the support spokes distally from the hub, and a cloth adapted to be stretched over the support spokes;

whereby the wall panels can be slid into the groove of the lower frame member, each groove of the connecting member can be slid over two side edges of two corresponding wall panels, and the groove of the upper frame member can be affixed on the top edges of the wall panels to form a prefabricated building without the need of external support.

10. The prefabricated building kit of claim 9 wherein the lower frame is comprised of a plurality of individual U-shaped beams adapted to be secured together by connecting plates and the upper frame member is comprised of a plurality of individual U-shaped beams adapted to be secured together by connecting plates.

11. The prefabricated building kit of claim 9 wherein each wall panel includes an outer resilient plate, an inner resilient plate, and a honeycomb core connecting the outer resilient plate and the inner resilient plate.

12. A building structure comprising:

a plurality of wall panels, each wall panel including a top edge, a bottom edge and at least two side edges;

means for connecting the side edge of one wall panel to the side edge of a corresponding adjacent wall panel;

a plurality of lower U-shaped members secured to the bottom edges of the wall panels, each lower member being associated with the bottom edge of a corresponding wall panel;

a plurality of upper U-shaped members secured to the top edges of the wall panels, each upper member being associated with the top edge of a corresponding wall panel;

means for connecting the lower U-shaped members to define a lower frame member;

means for connecting the upper U-shaped members to define an upper frame member; and a roof removably fastened to the upper frame member, the roof comprising a sheet covering and a plurality of support spokes securely fastened to the upper frame member and joined in a hub, the support spokes being covered with the sheet covering and being supported by a plurality of reinforcing bars securely fastened between the support spokes distally from the hub.

13. The building structure of claim 17 wherein each wall panel includes an outer resilient plate, an inner resilient plate, and a honeycomb core connecting the outer resilient plate and the inner resilient plate.

14. The building structure of claim 12 wherein the means for connecting the side edges are connecting members which secure two side edges of two corresponding adjacent wall panels.

15. The building structure of claim 12 wherein the lower frame member displaces the wall panels off the ground.

16. The building structure of claim 12 wherein the wall panels are displaced off the ground by ridges provided on the lower U-shaped members.

17. The building structure of claim 12 wherein the lower U-shaped members are secured together by releasable connecting members.

18. The building structure of claim 12 wherein the upper U-shaped members are secured together by releasable connecting members.

* * * * *

UNITED STATES PATENT AND TRADEMARK OFFICE

CERTIFICATE OF CORRECTION

PATENT NO. : 4,910,928

DATED : March 27, 1990

INVENTOR(S) : Charles Cellar, Jr.

It is certified that error appears in the above-identified patent and that said Letters Patent is hereby corrected as shown below:

In Column 3, line 65, "122" should read --12--.

Col. 8, claim 13, line 13, "17" should read --12--.

Signed and Sealed this

Thirteenth Day of August, 1991

*Attest:*

HARRY F. MANBECK, JR.

*Attesting Officer*

*Commissioner of Patents and Trademarks*